United States Patent [19]

Antelman et al.

[11] 4,424,438

[45] Jan. 3, 1984

[54] REMOTE ACTUATOR SYSTEM

[75] Inventors: Stanley I. Antelman, Sacramento, Calif.; Charles Ladue, Phoenix, Ariz.

[73] Assignee: Stanmar Technology, Sacramento, Calif.

[21] Appl. No.: 318,400

[22] Filed: Nov. 5, 1981

[51] Int. Cl.[3] ..... H05B 1/02

[52] U.S. Cl. ..... 219/491; 4/559; 4/504; 219/506; 219/501; 361/191

[58] Field of Search ..... 219/362, 364, 490–493, 219/494, 501, 506; 4/538, 559, 504, 492, 493; 361/191, 91, 56

[56] References Cited

U.S. PATENT DOCUMENTS

| | | | |
|---|---|---|---|
| 3,719,828 | 3/1973 | Lipskin | 361/191 |
| 3,858,094 | 12/1974 | Hanchett, Jr. | 361/191 |
| 4,292,542 | 9/1981 | Bajka | 361/191 |
| 4,315,297 | 2/1982 | Kobayashi et al. | 361/191 |
| 4,321,644 | 3/1982 | Brasfield | 361/56 |
| 4,360,850 | 11/1982 | Howard et al. | 361/56 |

*Primary Examiner*—M. H. Paschall
*Attorney, Agent, or Firm*—Mark C. Jacobs

[57] ABSTRACT

A control system for selectively turning on and off various electrical devices used in the operation of a spa is disclosed. The control system includes a power supply for generating a 5 volt DC voltage from a 120 volt AC external power source, a timing circuit, a clearing circuit and a plurality of control circuits, one for each device to be controlled. Each control circuit, which is driven by the 5 volt DC voltage, includes a relay which is adapted to be coupled to the electrical device to be controlled, a momentary manually operated switch, a pair of flip-flops, a gate, a transistor, and an incadescent light bulb. In the operation of the circuit the transistor is turned on and off by the flip-flops and the output of the transistor is used to energize or deenergize the relay. Because the circuits operate at low DC voltage, the switches through which these voltages are transmitted can be located at or near the spa without causing potential safety problems. In a specific embodiment disclosed, an air blower pump, a booster pump, a circulating pump and a heater are controlled and the lighted switches are located in a first box adapted to be located at the vicinity of the spa. The first box is connected by wires to a second box containing the other components and is adapted to be located remote from the spa, preferably in the vicinity of the electrical devices being controlled. Integrated circuits and passive parts are used for all components in the control system.

10 Claims, 9 Drawing Figures

REMOTE ACTUATOR SYSTEM

BACKGROUND OF THE INVENTION

The present invention relates generally to control systems and more particularly to a control system for remotely controlling the operation of the pumps and other electrical equipment used in a spa.

While the popularity of backyard swimming pools is still high, especially in the sunbelt, the energy crunch, inflation, and the high initial cost coupled with space requirements are all reasons that more and more people are installing spas and hot tubs.

It is predicted that eventually that there will be more spas and hot tubs than swimming pools. This is due to the combination of lower initial cost, low maintenance, and less space and energy utilization. Spas are considered romantic, as well as being good family entertainment so there is appeal to all ages.

It should be understood that in the trade, a water vessel or container constructed of redwood, mahogany or cedar boards, usually 2×4s with a wood bottom are referred to as hot tubs. Vessels formed of molded fiberglass, acrylic polymer or cross-linked polyethylene in various colors and shapes are referred to as spas. Their intended use however is the same and collectively in this patent application the term spa shall be deemed to be inclusive of both unless otherwise recited.

In the spectrum of a spa there are various functions all of which must be controlled. The water must be filtered, and it must be heated. In addition, spas have water circulation jets that mix air and water and effect this mixture thru a series of venturiis into the water volume of the spa to achieve the hydromassage effect on the people therein. A further feature is the blowing of air bubbles through the water from tiny apertures usually in the seat.

All of these functions are operated by pumps and motors usually disposed on a wooden skid or concrete pad remotely located from the spa. Remote locations are employed since the spa equipment package is not aesthetically pleasing, and the motors are usually quite noisy. The equipment (i.e. motors and pumps) is normally run on 120 volts AC and the switches for controlling the equipment are usually connected directly to the 120 volt line to each device. Accordingly, for safety reasons, the switch box containing the switches is also located remote from the spa. In actual useage, people often find it a disadvantage to have to walk over rocks, concrete or through plants or weeds to the switchbox, especially when one is dripping wet and perhaps nude. Therefore people give a second thought to leaving the spa to turn on the air bubbles or to turn off the "jets" as the case may be from time to time.

While there have been attempts to control some of the pumps and motors by remote switching devices, usually these have been limited to controlling only the heater and the filter. Typical of such controllers is the Model CM101 made by Catalina Controls Corporation of Boulder, Colo. This is a magnetic control and not an electrical system.

Another unit known to applicant is the Spa-Temp TM Control Center made by Ramco Mfg., Inc. of San Jose, Calif. These suffered from limited utility, i.e., non-applicability to two speed pumps, according to information obtained from spa dealers.

Applicant is also aware of control systems that utilize so called "air switches" where a diaphragm is actuated by the operation to emit a puff of air that controls or operates a switch.

These last suffer from early failure due to the fact that ambient heat affects the elasticity of the diaphragms and the air lines suffer air loss due to pin hole breaks, thereby causing or contributing to switch failure.

There is thus a need for a novel control system capable of remotely controlling all of the equipment used in operating a spa and in controlling such equipment in a manner which does not represent a safety problem. The present invention provides such a system for both 110 V and 240 V motors.

It is an object therefore of this invention to provide a new and improved control system.

It is another object to provide a control system for controlling the equipment used to operate a spa which includes a switching mechanism which can be safely located at the spa itself.

It is still another object of this invention to provide a control system which operates on low voltages and which has built in safety features.

It is yet another object to provide a control system that includes features for preventing damage to the heater.

A further object is to provide a control system that permits independent actuation of the filter, heater, air blower, and jets, and even other non-related functions such as lights from a central location adjacent the spa.

Still another object is to provide a system that permits an actuated function to be overridden if desired.

These and other objects and advantages of this invention will be made more apparent from a reading of the specification, drawings and appended claims.

SUMMARY OF THE INVENTION

A low voltage control system for turning on and off the various electrical devices which may be used in the operation of a spa constructed according to the teachings of this invention includes a power supply for converting 120 VAC from an external power source into 5 VDC and a separate low voltage control circuit for each device to be controlled. Each control circuit includes a relay coupled to the electrical device to be controlled, and a momentary manually operated switch, a pair of flip-flops and a transistor which are powered by the 5 VDC from the power supply and which collectively are used to generate a signal which energizes or deenergizes the particular 25 V relay. Because the circuits operate with low voltages, the switches through which the low voltages are transmitted can be located at or near the spa without causing potential safety problems. In a specific embodiment disclosed, an air blower pump, a booster pump, a circulating pump and a heater are controlled and the switches along with individual incadescent lamps for indicating if the relays are energized are located in a first box adapted to be located at the vicinity of the spa, the first box is connected by wires to a second box containing the other component and which is located remote from the spa, preferably in the vicinity of the electrical devices being controlled. The control system also includes a clocking circuit and a clearing circuit for safety reasons.

While the discussion will pertain to 120 VAC, it is to be understood that the control system is equally applicable to 240 VAC powered spa functions. Also the term L.E.D. is an abreviation for light emitting diode.

BRIEF DESCRIPTION OF THE DRAWINGS

In the drawings wherein like reference numerals represent like parts.

DETAILED DESCRIPTION OF PREFERRED EMBODIMENT

Although the invention will be hereinafter described in connection with controlling the operation of an air blower pump, a booster pump, a circulating pump and a heater it is to be understood that these particular electical devices selected are for illustrative purposes only and that the number or type of electrical devices to be controlled can be changed as desired or required. Also, although the invention is specifically intended for use in spas, it may find use in other environments such as swimming pools or other equipment where efficient, safe, low voltage remote control is desired.

Figure 1:
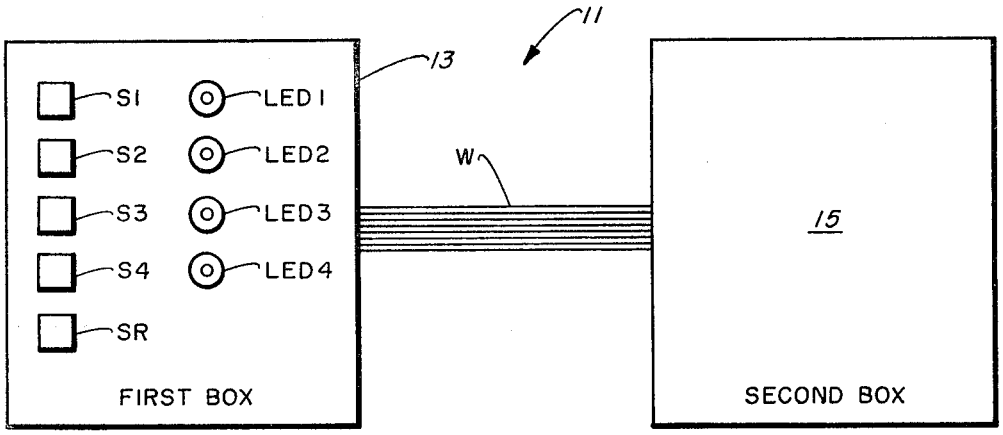
FIG. 1 is a block diagram of a physical implementation of a control system constructed according to the invention.

Referring now to FIG. 1 there is illustrated a block diagram of a physical implementation of the control system of the invention identified generally by reference numberal 11.

Control system 11 includes a first box 13, a second box 15 and a plurality of wires W connecting first box 13 to second box 15. First box 13 includes a plurality of switches S1, S2, S3, S4, SR and a plurlity of light emitting diodes LED1, LED2, LED3 and LED4 and is the box that may be located at or near the spa. Second box 15 contains the remaining elements of the control system 11 and is located remote from the spa, preferably near the particular electrical devices being controlled.

Figure 2:
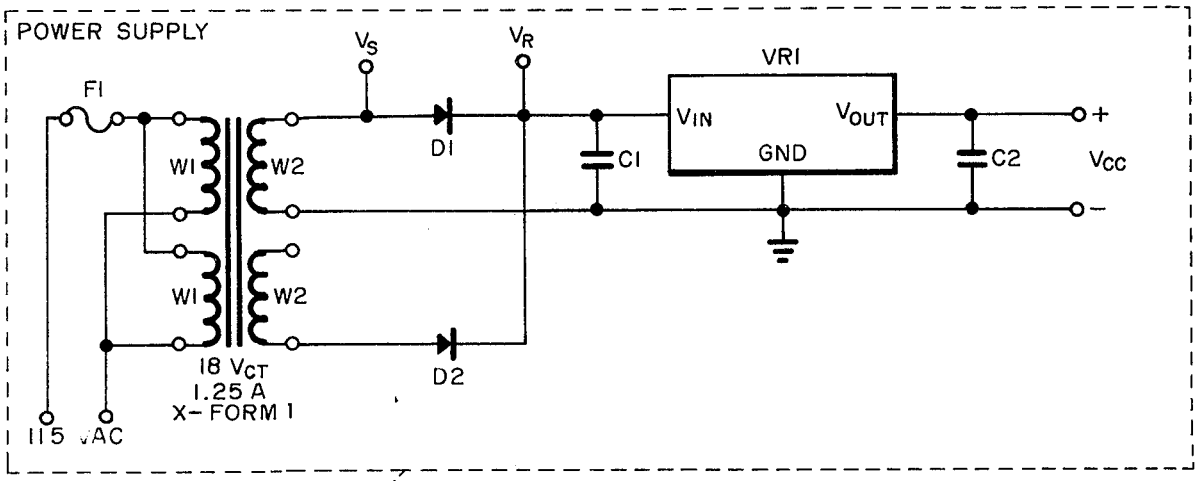
FIG. 2 is a schematic diagram of the power supply circuit portion of the control system.

Referring now to FIG. 2, there is shown a schematic diagram of the power supply circuit 21. Power supply circuit 21 includes a transformer T whose primary winding $W_1$ are connected to an external 115 VAC source of power (or to a 230 VAC power source with proper modification). The output Vs at the secondary windings W2 is then full wave rectified by two diodes D1 and D2. The rectified voltage $V_R$ is then passed through a capacitor C1 which filters out the DC component wave. When a 36 V centre top transformer's parallel hook up current is so treated it will produce a $V_R$ of 25 clean volts A.C. The filtered wave is then applied to a voltage regulator VR1 whose output is a constant 5 volt signal. The output of regulator VR1 is then passed through a capacitor C2 which filters out any ripple in the resulting regulated voltage $V_{cc}$.

Figure 3:
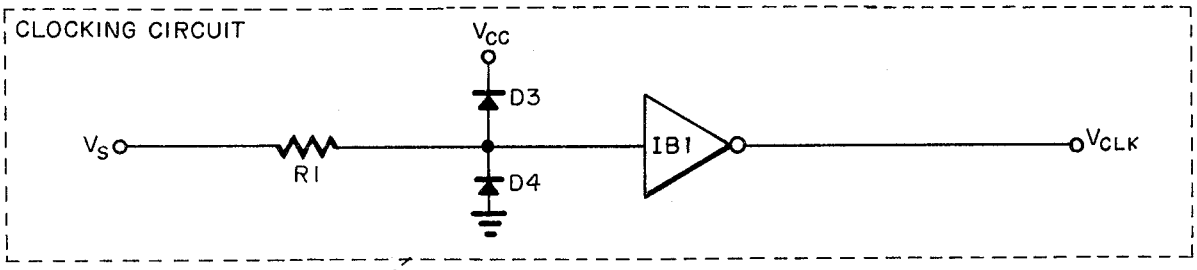
FIG. 3 is a schematic diagram of the clock pulse generating circuit portion of the control system.

Referring now to FIG. 3, there is shown a schematic diagram of the clocking circuit 23. The output voltage $V_s$ of the secondary coil W2 of the transformer T is passed through a resistor, R1, for current limiting. The voltage is then passed through a diode network D3, D4 which produces an output voltage in the form of a 60 HZ square wave. The voltage is then input to an inverter, buffer network IB1 to produce a good (i.e. fast rise and fall times) square wave output, $V_{CLK}$.

Figure 4:
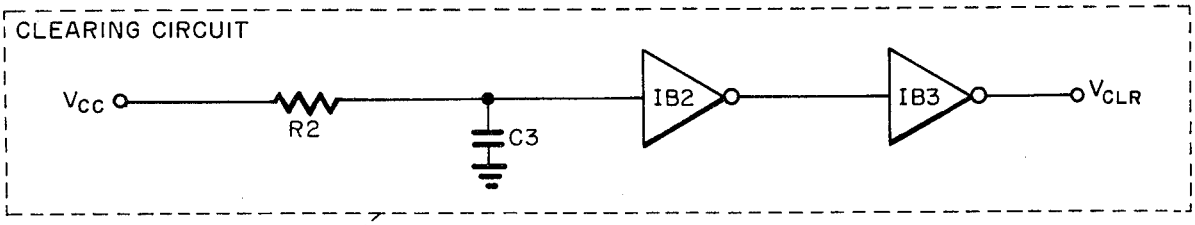
FIG. 4 is a schematic diagram of the clearing circuit portion of the control system.

Referring now to FIG. 4, there is shown a schematic diagram of the clearing circuit 25. The regulated output voltage $V_{cc}$ from power supply 21 is passed through an RC network having a time constant of 10 m sec. and made up of resistor R2 and capacitor C3 and is then applied to two inverting buffering amplifiers IB2 and IB3 to produce a voltage source $V_{CLR}$ which is used to drive five clearing circuits on D type flip flops (to be hereinafter described).

Figure 5:
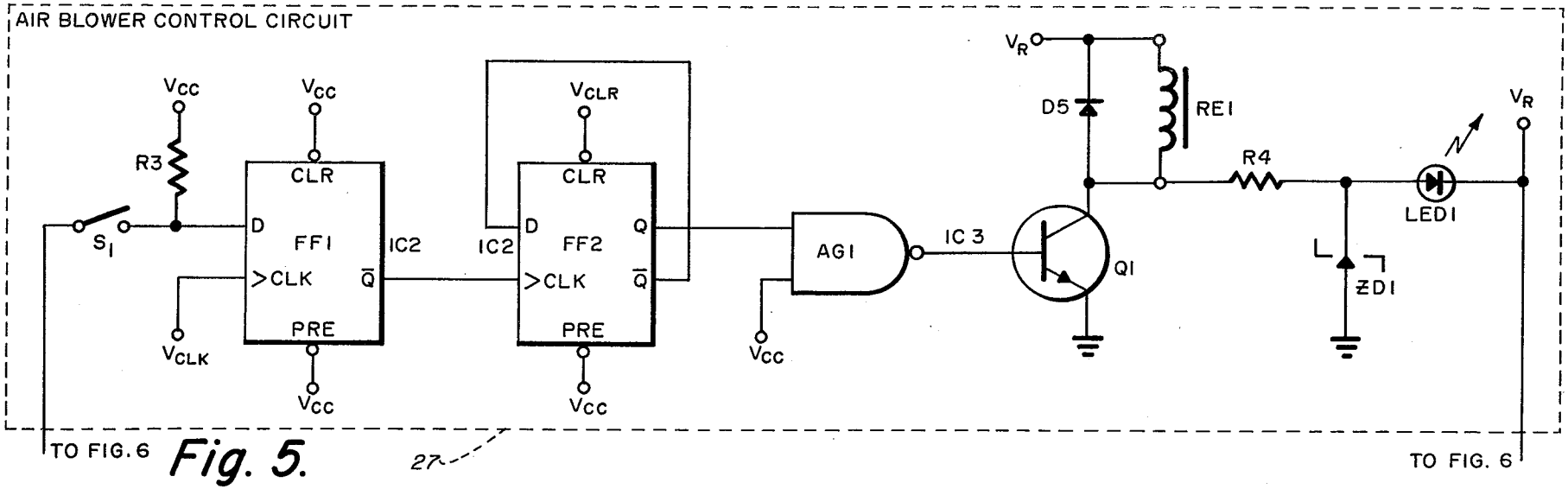
FIG. 5 is a schematic diagram of the air blower control circuit portion of the control system.

Referring now to FIG. 5, there is illustrated a schematic diagram of the air blower control circuit 27. The circuit includes a manually operated switch S1, a resistor R3, a pair of D flip-flops FF1 and FF2, and AND gate AG1, a transistor Q1, a diode D5, a relay RE1, a resistor R4, a zener diode ZD1, a high frequency decoupling capacitor, and a light emitting diode LED1.

When power is first applied to the circuit, $V_{CLR}$ takes 10 milliseconds to reach its final value, whereas $V_{cc}$ reaches its final value instantaneously. Because of the 10 millisecond delay, Q, the output of flip-flop FF2 is cleared to an output of zero volts, (a low or zero level). The Q output of flip-flop FF1 is not cleared because when power is applied to the circuit a high voltage is applied to input D on flip-flop FF1. This voltage is then clocked through to Q on flip-flop FF1 which produces a high level on Q and a low level on Q of FF1.

When switch, S1, (a momentary switch) is closed input D of flip-flop FF1 has a low voltage, the 60 HZ clock then pulses this through to Q. The clock is used to alleviate the bounce characteristics of a momentary switch. Since the Q, on flip-flop FF1 is low, the $\overline{Q}$ on flip-flop FF1 is high. Since $\overline{Q}$ on FF1 was low and then went high, it acts like a clock pulse to the clock input of flip-flop FF2. When power is first applied to the circuit, Q flip-flop FF2 is low therefore Q of flip-flop FF2 is high. $\overline{Q}$ of flip-flop FF2 is tied to D on flip-flop FF2. Therefore, when the $\overline{Q}$ of flip-flop FF1 transcends from a low to a high state the high level on D of flip-flop FF2 is pulsed through to produce a high on Q of flip-flop FF2. Since switch S1 is a momentary switch the D input of flip-flop FF1 sees a low then a high voltage. The 60 HZ clock pulses the low voltage which sets the Q of flip-flop FF2 to a high level. The 60 HZ clock then pulses the high voltage to produce a low voltage on $\overline{Q}$ of flip-flop FF1. Since the flip-flop only reacts to a low to high clock pulse, the $\overline{Q}$ of flip-flop FF1 transition from a high to a low level will not act as a clock pulse on flip-flop FF2. The high level on Q of flip-flop FF2 dictates a low voltage on $\overline{Q}$. Since $\overline{Q}$ is tied to D of flip-flop FF2 the D input sees a low voltage. The next time switch S1 is closed this low voltage on D of flip-flop FF2 is clocked through to produce a low voltage on Q of flip-flop FF2 and the circuit is now back to its original off state. Because of the way the flip-flops have been hooked up, the inherent effect will be to debounce the switch. A debounce circuit as just described gives rise to the effect that when a switch is pressed, the contacts make contact only one time rather than a plurality of times with a damping effect that requires a finite time to settle down to a steady state condition.

The output Q of flip-flop FF2 is then used to turn on or off a transistor Q1.

The Q output of flip-flop FF2 is input to one of two inputs of an AND gate AG1 which has one input tied to a high. When Q is high the output of the AND gate AG1 is a high. This turns transistor Q ON which allows current to flow from $V_R$ through the relay to ground. The relay is then energized and the Air Blower pump is turned on. When transistor Q1 turns on a current is also allowed to flow through LED1. Resistor R4 is put in series with the LED 1 to limit current. Zener diode ZD1 is tied to this line such that if a voltage is greater than 25 volts accidently get on the circuit, the circuitry is protected because zener diode ZD1 takes all excess voltage to ground. The capacitor $C_A$ is used to short all high frequencies to ground.

When Q is reset to a low state transistor Q1 is turned off and relay RE1 and LED1 deenergized. A Diode D5 is wired in parallel with the relay RE1 to prevent current from flowing backwards through the relay circuit.

Thus, relay RE1 is energized by a signal from transistor Q1 which is controlled by a signal received from flip-flop FF2 when switch S1 is depressed.

Figure 6:
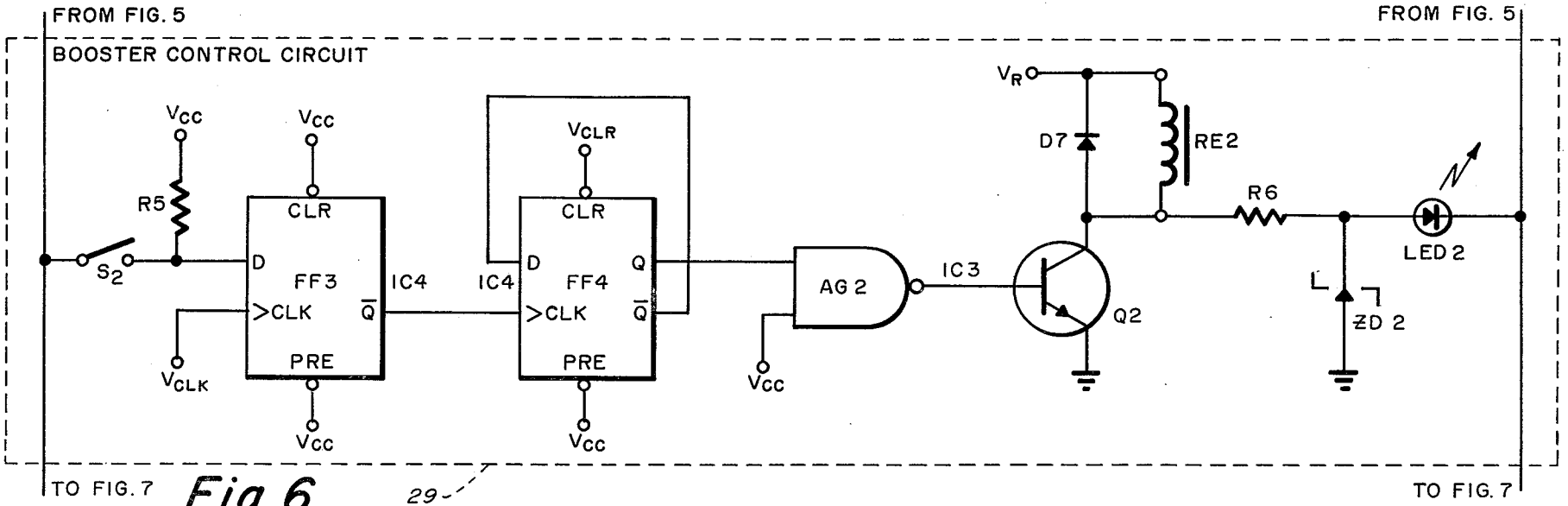
FIG. 6 is a schematic diagram of the booster control circuit portion of the control system.

Referring now to FIG. 6, there is illustrated a schematic diagram of the booster control circuit 29. The circuit includes a manually operated switch S2, a resistor R5, a pair of D flip-flops FF3 and FF4, an AND gate AG2, a transistor Q2, a diode D7, a relay RE2, a resistor R6, a zener diode ZD2 a capacitor $C_B$ and a light emitting diode LED2. The circuit is arranged in the same manner and operates in the same manner as blower control circuit 27. Reference to FIG. 5 will confirm the similarity but for part numbering.

Figure 7:
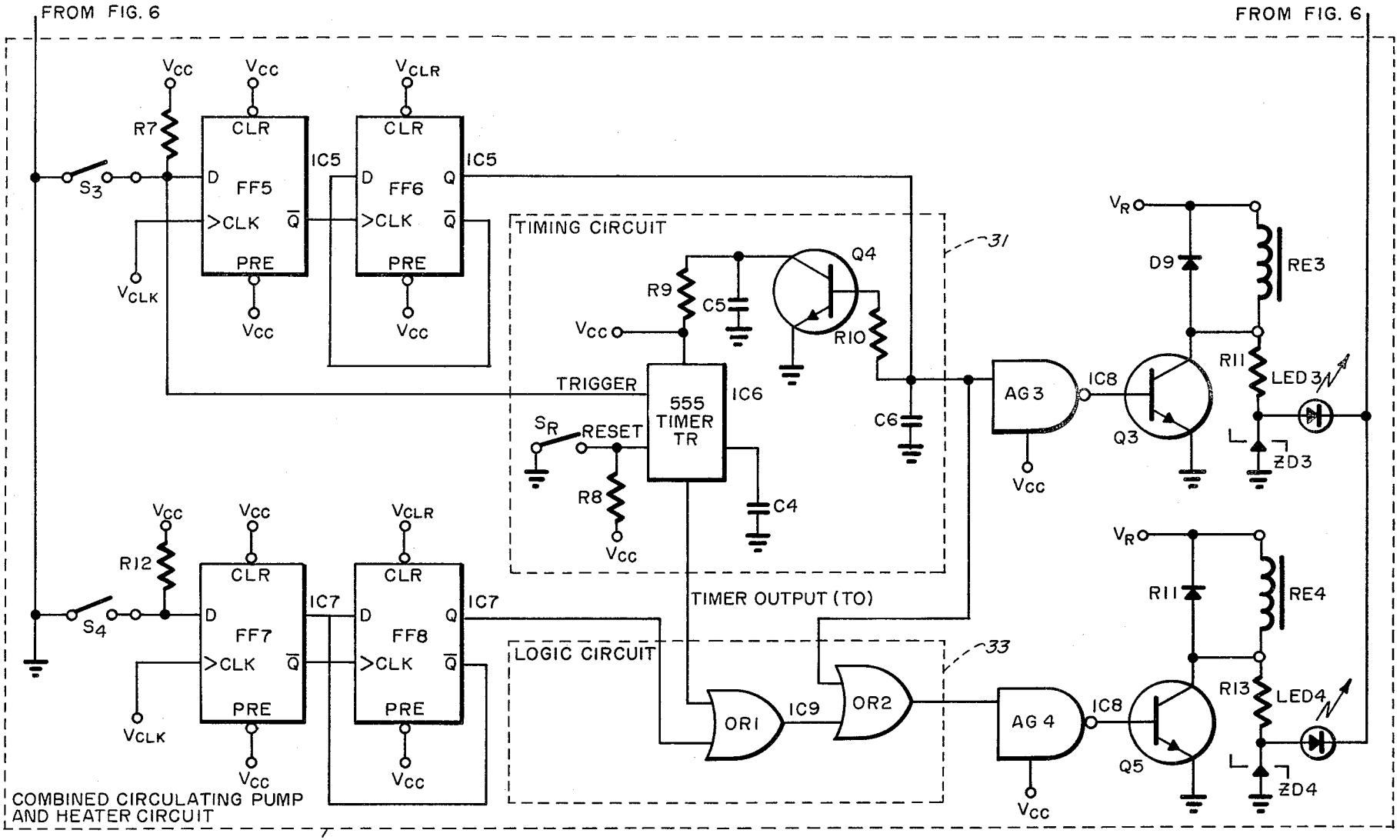
FIG. 7 is a schematic diagram of the combined circulating pump and heater circuit portion of the control system.
Figure 8:
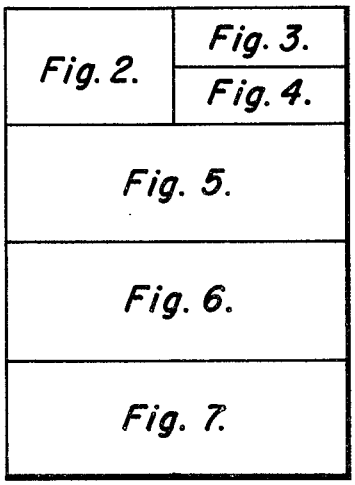
FIG. 8 is a composite block diagram showing how the circuit portions of FIGS. 2–7 are combined into a single overall circuit.

Referring now to FIG. 7, there is illustrated a schematic diagram of the combined circulating pump circuit and heater circuit 30.

The heater circuit portion of combined circulating pump circuit and heater circuit 30 includes a switch S3, a pair of D type flip-flops FF5 and FF6, an AND gate AG3, a transistor Q3, a diode D7, a relay RE3, a resistor R11, a zener diode ZD3, a capacitor $C_C$ and a bulb or L.E.D. LED3 which are arranged as and operate the same as the D flip-flops and the AND gate transistor circuits in the Air Blower and Booster Circuits. However, the Q output from flip-flop FF6 is also used in a timing circuit 31 and a logic circuit 33.

The circulating pump portion of the combined circuit 30 includes a switch S4, a pair of D type flip-flops FF7 and FF8, an AND gate AG4, a transistor Q5, a diode D11, a relay RE4, a resistor R13, a zener diode ZD4, a capacitor $C_C$ and an incadescent light bulb LED4 which are arranged and operate the same as the D flip-flops and the AND gate transistor circuits in the Air Blower and Booster circuits. However, the Q output of flip-flops FF8 is sent to logic circuit 33 rather than directly to AND gate AG4.

Timing circuit 31 includes a reset switch SR, a resistor R8, a timer TR, capacitors C4, C5 and C6, resistors R9 and R10 and transistor Q4. Logic circuit 33 comprises two OR gates OR1 and OR2. Switch SR is a momentary switch. See infra.

The timing circuit 31 is used so that when the heater circuit is deenergized the circulating pump runs for approx. 10 mins. before turning off. The timer TR is started by receiving a pulse that changes from a high state to a low and then back to a high. This pulse is generated by monitoring the heater switch S3. See below. Ten minutes is adequate to cool the "off" heating element down with flowing water.

When the switch S3 is momentarily grounded the signal charges from a high to a low and then back to a high. When the pulse is received the RC circuit made up of resistor R9 and capacitor C5 begins timing. The time constant is determined by R9 and C5. In order to keep the circuit from timing when the heater circuit is energized transistor Q4 is used such that when the Q output of the heater circuit is high (the heater is ON) transistor Q4 is turned on continually discharging capacitor C5. Resistor 10 and capacitor C6 provides base current limiting and base-emitter voltage biasing.

When the heater circuit is turned off, timer TR receives a pulse telling the capacitor C5 to begin charging up. The Timer TR output which is connected to logic circuit 33 is set high when the pulse is received. Also, since the Q output of the heater circuit is low transistor Q4 is turned off and the capacitor C5 is allowed to charge up. When the capacitor C5 is charged to a certain value, timer TR changes its output to a low, thus sending a low to the logic circuit 33.

Capacitor, C4 is used for the threshold voltage. The voltage is also used to reference the capacitor C5 voltage. Capacitor C6 is charged to a threshold voltage by the timer TR.

Timing circuit 31 has also been provided with an override capability. This capability allows the resistor R8 to be bypassed with a short circuit which automatically charges the capacitor, C4 to $V_{cc}$ and forces the timer TR out put low, turning the circulating pump off without having to wait the required ten minutes.

Logic circuit 33 is used for controlling the circulating pump AND gate AG4 and transistor Q5 circuit. The operation of the OR gates OR1 and OR2 are such that if either input or both inputs are a high voltage the output is a high voltage.

The circuit has three inputs, namely the Q output of the circulating pump D flip-flop FF8, the Q output of the heater circuit D flip-flop FF6 and the timer output TO.

If the circulating pump is to be used exclusive of the heater, once the Q output of the D flip-flop FF8 is set to a high level the transistor Q5 will turn ON and the circulating pump will energize.

If the heater is turned on the circulating pump must also be turned on. Therefore, the Q output of the heater D flip-flop FF6 is used. Once the heater is turned off the timer output TO is set high to keep the circulating pump operating until timer TR times out and drives its output low turning the circulating pump off. Timing circuit 31 may be adapted by means known to the art to extend or shorten the continued running of the circulating pump CP not shown. The period 10 minutes as recited earlier herein is the time period deemed necessary by pool and spa heater experts for enough water to be circulated through the heater H, to cool down the heating elements. Resident hot water, i.e., water left in the heater after the heating elements have been turned off, could damage the heater or shorten its useful life.

The timing circuit 31 has been provided with override capability such that in case of an erroneous activation of the heater, it can be turned off immediately, without the 10 minutes of water circulating through it. This is an accepted procedure since the heater at this point in time is not hot. Generally however, turning on the heater H also activates the circulating pump CP, but actuating the circulating pump, i.e., the filteration system as noted by button F in FIG. 9 doesn't activate the heater. This is due to the fact that pool and spa water needs a longer period of filtration in many cases than it needs heat. But heat, when desired, cannot be had without the pump, i.e., filtration system to circulate water through the heater.

The timing circuit has been indicated as containing a reset switch SR. As was previously discussed, when the heater is turned off, the timing circuit keeps the circulating pump running about 10 minutes after the heater is turned off. Hot standing water is known to be damaging to a heater's element, and so water is kept circulating through the heater to dissipate any heat present past shut off.

Since the filter is jointly activated with the heater, when the heater is turned on, and will run for 10 minutes or so, depending upon the value of resistors connected in the timing circuit, if the heater is inadvertently turned on, both the heater and circulation pump can be immediately deactivated. The heater button when pulled again will turn off the heater. As to the circulation pump, it can be instantly turned off by pushing the override or reset switch SR. While switch SR could be physically located at the spa site in box 1, it was felt for safety reasons,—safety of the equipment—that it should be placed at box 2, to thereby force the operator to walk to it to reset it. This prevents the operator from readily pushing the reset switch SR to conveniently supercede the extra pump cycle time when the heater has been in operation a finite time.

Figure 9:
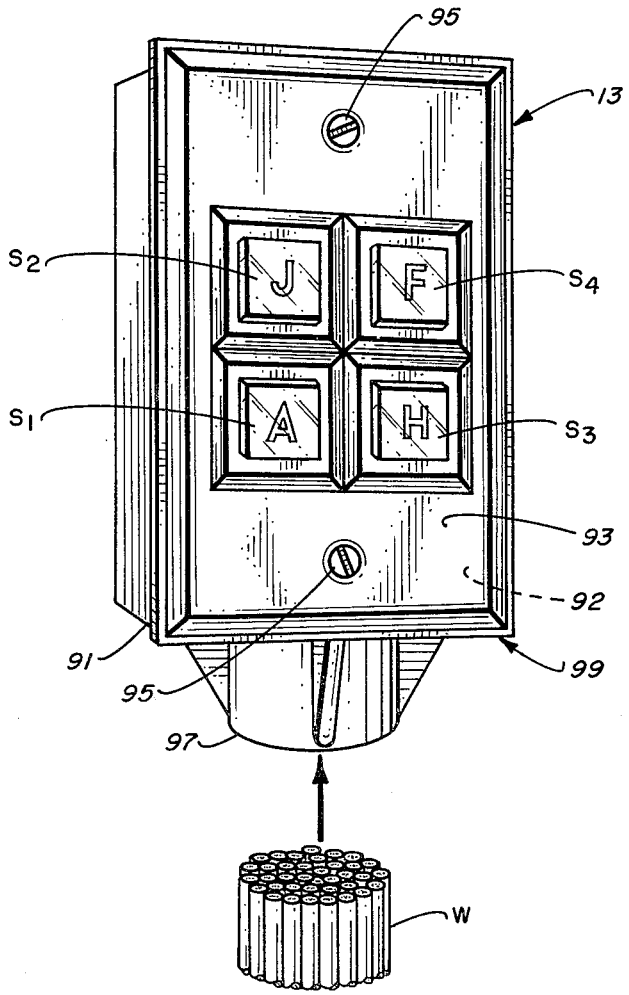
FIG. 9 is a front perspective view of a typical embodiment of the first control box employed herein.

Turning now to FIG. 9, which illustrates a typical embodiment of the first box 13. Box 13 includes an enclosure 91 having a front, preferably, opening 92 which is enclosed by cover plate 93. Plate 93 is secured by screw 95 to threaded bores not seen in enclosure 91. Wires W are inserted in bottom preferably, opening 97 for attachment to the various switches discussed in detail above.

The letter designators convey the following meaning:

S1—A—Air—air bubbles

S2—J—Jets—air water mixture

S3—H—Heater

S4—F—Filter (circulating pump)

Each of these switches has been described as being lit by an LED, light emitting diode. Obviously standard minature lamps can be employed equally as well, e.g. from Chicago Miniatures.

Switches 1–4 are readily available in the marketplace from various vendors. These switches include suitable means to protect them against the intrusion of occasional water droplets.

Interposed between cover plate 93 and enclosure 91 is a watertight guard 99 to ensure that the operator's hands that may have some water droplets thereon can't leak in during an actuation cycle to short circuit the circuitry.

If the first or switch box is to be located in the outdoors, as opposed to a gazebo or the interior of a building,—where it will be subjected to rain or snow—an optional hinged cover often used for outdoor toggle switch boxes may be employed superposed upon cover plate 93. Such hinged covers are known to the art and are available from Bell Electric among others, and may be of plastic or metal.

For mounting, box 13 can be mounted on plastic or metal conduit not shown, through which wires W from the second switch are fed.

Other mounting means known to the art such as hangers, etc. may be employed.

While shown in FIG. 9 as having four switches, more or less than 4 can be employed. Thus for concrete (gunite) pools that have a separate spa section, no air bubbles are ejected thru the seat since it is solid concrete. On the other hand additional switches may be provided to actuate lighting in the vicinity of the spa or in the spa itself, or both. This extra point would be a duplicate of the air blower or heater circuits.

While the lighting of the switches has been indicated as LED 1–4, such terminology applies to both light emitting diodes and incandescent bulbs. Both types of light sources are found in the marketplace as indication means for the switches, which are preferably push button. Rocker or paddle switches can also be employed if desired.

The first box 13 may be interconnected to second box 15 by a series of low voltage carrying wires. Electrical codes will require that these wires be carried by electrical conduit, or be grouped together to form a multiconductor "direct burial" cable that has special environmental and ground working tool resistance characteristics. Such direct burial cable is known in the art.

In order to convert the instant system to operate 240 VAC powered systems, only a change of pin connections in the input coil of the transformer are necessary. Such changes are readily made during the course of manufacture of the device. Thus the instant remote control system can be employed for both new installations as well as for the retrofit aftermarket for both 120 and 240 volt pumps as the connections of either to the instant invention is within the skill of the routine electrician.

It is to be specifically pointed out that all of the circuitry to the relays and the lamps of the switches are tied to ground through a common series of zenier diodes as shown in the Figures and as previously discussed with a breakdown voltage of 25 volts. If any of these 25 volt thresholds (breakdown voltages) are exceeded all excess voltage is shorted to ground. This prevents large voltages which could be unsafe especially to operator wet hands—from reaching the lamps and from reaching the relays thus also preventing relay overload.

Also if a large voltage was impressed on the input coil of a relay and then back through the circuit board, damage to the board would be extensive but for the presence of these zener diodes, one of which is connected to each relay and in parallel to each lamp.

Another added safety feature is the fusing of the input side of the transformer to prevent excess current input. Thus the system has both a voltage and a current safety parameter mode.

While the circuits as shown could function without the presence of $C_A$, $C_B$, $C_C$ and $C_D$ shown in the several figures, their presence is to act as a plurality of high frequency decoupling capacitors. These serve as low frequency filters to prevent the possibility of high frequency inductance in the multiple wire cable that interconnects Box 1 to Box 2. The resultant presence acts to ensure that non-desired actuation of additional functions do not transpire when operator actuated.

The reader's attention is drawn to the fact that parts designated as IB1, IB2, and IB3 may all be portions of a unitary integrated circuit or they may be separte "chips" as may be desired. To relate the nomenclature utilized herein to known to the art standard readily available parts, reference should be made to the following table:

| Pat. App. Part | Integ. Circ. Designation | Function |
|---|---|---|
| IB1, IB2, IB3 | 7404 | Hex Inverter |
| FF1, FF2 | 7474 | Dual Flip Flop |
| AG1, Q1, & AG2, Q2 | 75452 | Dual Driver |
| FF3, FF4 | 7474 | Dual Flip Flop |
| FF5, FF6 | 7474 | Dual Flip Flop |
| TR | 555 | Timer |
| FF8, FF9 | 7474 | Dual Flip Flop |
| AG3, Q3, & AG4, Q4 | 75452 | Dual Driver |
| OR1, OR2 | 7432 | 2 Input "OR" Gate |

The components set forth above can be obtained from at least one vendor and often more than one. The integrated circuits recited are intended to indicate the functions that they serve, rather than specific part designations. Thus other ICs that provide the same functions maybe employed.

Since certain changes may be made in the above apparatus without departing from the scope of the invention herein involved, it is intended that all matter contained in the above description and shown in the accompanying drawings shall be interpreted as illustrative and not in a limiting sense.

What is claimed is:

1. A low voltage control system for selectively turning on and off one or more of a plurality of electrical devices used in the operation of a spa, and which devices operate at around 120/230 VAC, comprising a plurality of low voltage activated electrical circuits, each electrical circuit operating one of said electrical devices, each electrical circuit including:

(a) a relay coupling said electrical device to a power source of 120/230 volts AC, (b) a low voltage momentary contact switch having a low voltage lamp electrically connected thereto to indicate when said switch is energized, (c) dual flip-flop means coupled to said switch to act as a flip-flop, said dual flip flop means further constituting a (d) debounce means connected to said switch;

(e) a high frequency decoupling capacitor connected to said switch to filter out any high frequency components of the electrical signal that can arise as a result of the relay switching, (f) transistor means coupled between said flip-flop means, said relay for energizing said flip-flop means when said switch is actuated, (g) a power supply including transforming, rectifying and voltage regulation means for providing low voltage operating power for said flip-flop means and said transistor means, and (h) a zener diode voltage overload means electrically connected to said relay and to said lamp.

2. The invention of claim 1 and wherein said flip-flop means comprises a pair of D type flip-flops.

3. The invention of claim 1 and further including an incandescent light bulb for indicating if said relay is energized.

4. The invention of claim 3 and further including a AND gate coupled between said flip-flop means and said transistor means.

5. The control system of claim 1 and wherein said switches are located remote from said relays, and each switch is a momentary switch.

6. The control system of claim 1 wherein the switches are interconnected by a multiconductor cable to the relays.

7. The control system of claim 1 wherein one of said circuits operates a heater and one of said circuits operates a circulation pump, and further including timing circuitry electrically connected to said pump circuit and said heater circuit, to simultaneously activate said pump circuit when said heater is activated.

8. In the system of claim 7 further including timing to maintain said pump circuit in an energized state for a finite time after said heater is de-energized.

9. In the system of claim 8 wherein the system contains four switches, one each for the heater, circulating pump, air blower and jets, all of which are push button momentary contact switches.

10. The low voltage control system of claim 1 further including a current limiting resistor coupled between said switch light and said transistor.

* * * * *